US010952283B2

(12) United States Patent
Jiang et al.

(10) Patent No.: US 10,952,283 B2
(45) Date of Patent: Mar. 16, 2021

(54) STRUCTURAL DESIGN AND PROCESS TO IMPROVE THE TEMPERATURE MODULATION AND POWER CONSUMPTION OF AN IR EMITTER

(71) Applicant: KONINKLIJKE PHILIPS N.V., Eindhoven (NL)

(72) Inventors: Zhi-Xing Jiang, Southbury, CT (US); Raymond Davis, Wallingford, CT (US)

(73) Assignee: Koninklijke Philips N.V., Eindhoven (NL)

( * ) Notice: Subject to any disclaimer, the term of this patent is extended or adjusted under 35 U.S.C. 154(b) by 703 days.

(21) Appl. No.: 14/361,524

(22) PCT Filed: Nov. 27, 2012

(86) PCT No.: PCT/IB2012/056755
§ 371 (c)(1),
(2) Date: May 29, 2014

(87) PCT Pub. No.: WO2013/080122
PCT Pub. Date: Jun. 6, 2013

(65) Prior Publication Data

US 2014/0339218 A1 Nov. 20, 2014

Related U.S. Application Data

(60) Provisional application No. 61/565,582, filed on Dec. 1, 2011.

(51) Int. Cl.

| | |
|---|---|
| ***H05B 3/10*** | (2006.01) |
| ***H05B 3/20*** | (2006.01) |
| ***H01K 3/02*** | (2006.01) |
| ***H01K 1/10*** | (2006.01) |
| ***H01K 1/20*** | (2006.01) |

(Continued)

(52) U.S. Cl.
CPC ..... *H05B 3/10* (2013.01); *H01K 1/10* (2013.01); *H01K 1/20* (2013.01); *H01K 1/58* (2013.01); *H01K 3/02* (2013.01); *H05B 3/0033* (2013.01); *H05B 3/20* (2013.01); *H05B 2203/032* (2013.01)

(58) Field of Classification Search
CPC ..... G05D 23/2413; G05D 23/241; G03G 15/2003
USPC ..... 219/543, 542; 392/479, 467; 338/226, 338/308
See application file for complete search history.

(56) References Cited

U.S. PATENT DOCUMENTS 3,875,413 A * 4/1975 Bridgham ..... H05B 3/26 250/492.1
4,859,858 A 8/1989 Knodle et al.
(Continued)

FOREIGN PATENT DOCUMENTS

DE 102004051364 A1 6/2005
EP 0776023 A 5/1997
(Continued)

*Primary Examiner* — Tu B Hoang
*Assistant Examiner* — Thomas J Ward
(74) *Attorney, Agent, or Firm* — Daniel H. Brean

(57) ABSTRACT

An infrared emitter is formed having a reduced thermal mass and increased thermal conductivity to effectively deliver and dissipate heat from a heating element that emits electromagnetic radiation. The improved thermal dynamic process may enhance one or both of power consumption and/or longevity.

14 Claims, 5 Drawing Sheets

(51) Int. Cl.
*H01K 1/58* (2006.01)
*H05B 3/00* (2006.01)

(56) References Cited

U.S. PATENT DOCUMENTS

| | | | | | |
|---|---|---|---|---|---|
| 4,859,859 | A | | 8/1989 | Knodle et al. | |
| 5,251,121 | A | | 10/1993 | Knodle et al. | |
| 5,369,277 | A | * | 11/1994 | Knodle | G01N 21/0303 219/553 |
| 5,822,675 | A | * | 10/1998 | Paquet | H05B 3/148 219/543 |
| 6,204,083 | B1 | | 3/2001 | Kodato et al. | |
| 7,389,431 | B2 | | 6/2008 | Ohara | |
| 8,410,676 | B2 | | 4/2013 | Feng et al. | |
| 2003/0044173 | A1 | * | 3/2003 | Natsuhara | F24H 1/102 392/479 |
| 2009/0085461 | A1 | | 4/2009 | Feng et al. | |
| 2014/0339218 | A1 | | 11/2014 | Jiang | |

FOREIGN PATENT DOCUMENTS

| | | | |
|---|---|---|---|
| EP | 2043406 | A2 | 4/2009 |
| JP | 2005183272 | A | 7/2005 |
| JP | 2008065930 | A | 3/2008 |
| JP | 2008218900 | A | 9/2008 |
| JP | 2010236934 | A | 10/2010 |
| KR | 20040049012 | A | 6/2004 |
| WO | 2008065930 | A1 | 6/2008 |

* cited by examiner

STRUCTURAL DESIGN AND PROCESS TO IMPROVE THE TEMPERATURE MODULATION AND POWER CONSUMPTION OF AN IR EMITTER

CROSS-REFERENCE TO PRIOR APPLICATIONS

This application is the U.S. National Phase application under 35 U.S.C. § 371 of International Application No. PCT/IB2012/056755, filed on Nov. 27, 2012, which claims the benefit of U.S. Provisional Patent Application No. 61/565,582, filed on Dec. 1, 2011. These applications are hereby incorporated by reference herein.

BACKGROUND

1. Field

The present disclosure pertains to an infrared emitter usable in an IR gas detection system, the infrared emitter having enhanced efficiency and/or longevity.

2. Description of the Related Art

Infrared emitters formed on substrates having low thermal conductivity are known. Infrared electromagnetic radiation is emitted from such an emitter by an emissive layer disposed on the substrate. Electrical current is provided to the emissive layer by electrical leads disposed on the substrate. Generally, the substrate has a thickness of at least about 0.005 inches. Rather than attempting to reduce the thermal mass of the emitter as a whole, conventional infrared emitters tend to be formed with what was previously perceived to be a balanced level of thermal mass.

SUMMARY

Accordingly, one or more aspects of the present disclosure relate to an infrared emitter. In some embodiments, the emitter comprises a substrate, a heating element, and a dispersive layer. The substrate has a first surface and a second surface opposite the first surface, and is substantially planar. The heating element is disposed on a portion of the first surface of the substrate, and is configured to emit infrared electromagnetic radiation in response to an electrical current being introduced thereto. The dispersive layer is disposed on the first surface of substrate, has a thickness of less than about 40 μm, covers at least about 70% of the first surface, and is formed from a material having a thermal conductivity of at least 110 W/m ° C.

Yet another aspect of the present disclosure relates to a method of emitting infrared electromagnetic radiation. In some embodiments, the method comprises connecting a heating element with a power supply, the heating element being disposed on a substrate having a first surface and a second surface opposite the first surface, the substrate being substantially planar, the heating element being disposed on the first surface of the substrate and being configured to emit infrared electromagnetic radiation in response to an electrical current being introduced thereto, the heating element being connected with the power supply by a pair of leads disposed on the substrate, the pair of leads being configured to connect the heating element to a power supply to facilitate introduction of an electrical current to the heating element; directing an electrical current from the power supply through the heating element via the leads; emitting electromagnetic radiation from the heating element responsive to the electrical current; and dissipating heat from the substrate through a dispersive layer disposed on at least 70% of the first surface of the substrate, the dispersive layer being formed from a material having a thermal conductivity of at least about 110 W/m ° C.

Still another aspect of present disclosure relates to an infrared emitter. In some embodiments, the emitter comprises means for carrying components of the emitter, the means for carrying having a first surface and a second surface opposite the first surface, the means for carrying being substantially planar; means for emitting infrared electromagnetic radiation disposed on a portion of the first surface of the means for carrying, the means for emitting being configured to emit infrared electromagnetic radiation in response to an electrical current being introduced thereto; and means for dissipating heat disposed on at least 70% of the first surface of the means for carrying, the means for dissipating being formed from a material having a thermal conductivity of at least about 110 W/m ° C.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DETAILED DESCRIPTION OF EXEMPLARY EMBODIMENTS

Figure 1:
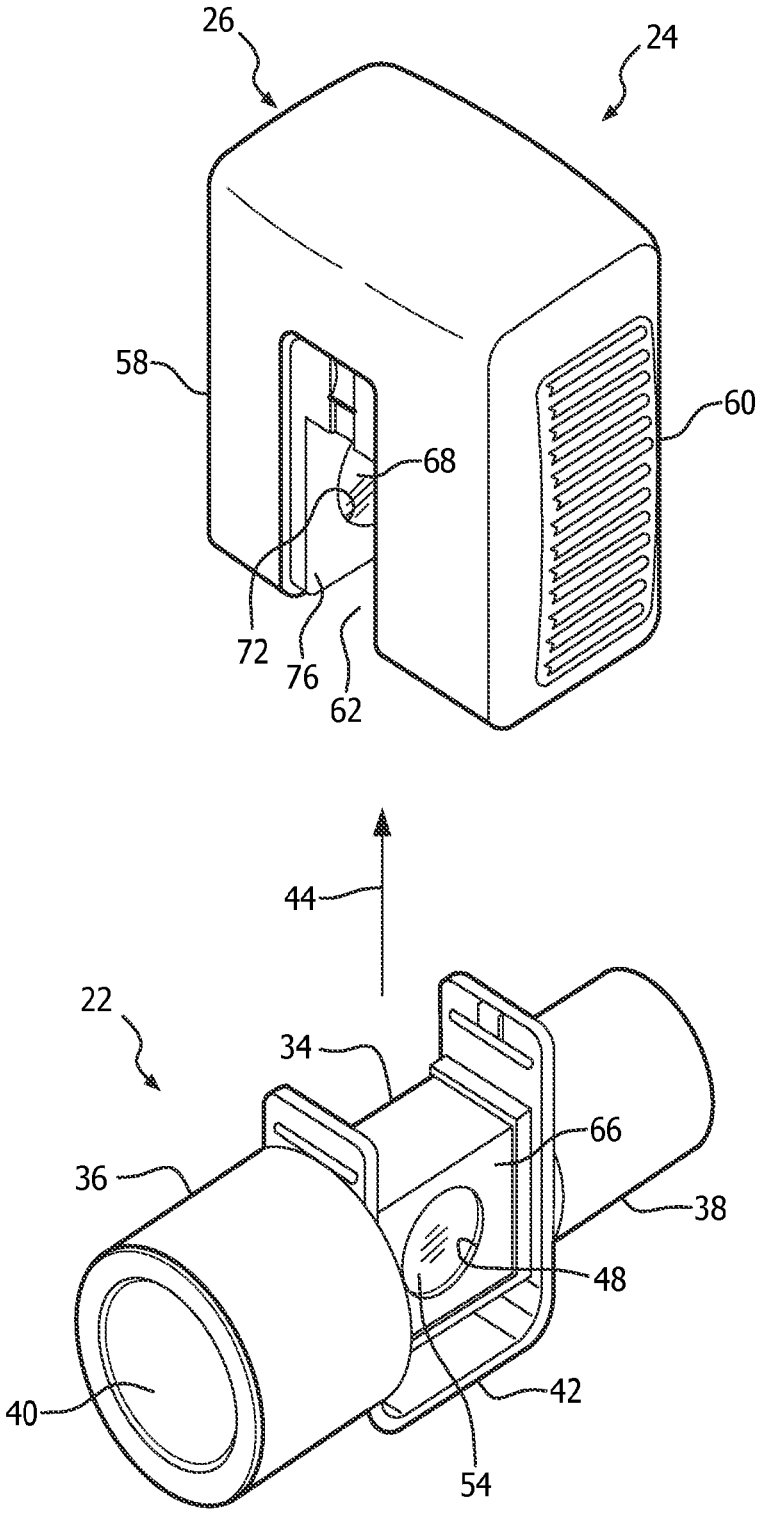
FIG. 1 is a an exploded view of an airway adapter and a transducer.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

The principles of the infrared emitter described herein can be employed in transducers for outputting: (a) a signal proportional in magnitude to the concentration of carbon dioxide flowing through an airway adapter in a patient-to-mechanical ventilator circuit, and (b) a reference signal. These signals can be ratioed in the manner disclosed in for example, one or more of U.S. Pat. Nos. 4,859,858; 4,859,859; and/or 5,369,277, which are hereby incorporated by reference in their entirety into the present application, to provide a third signal dynamically representing the concentration of the carbon dioxide flowing through the airway adapter. An exemplary airway adapter and a complementary transducer are shown in FIGS. 1 and 2 and respectively identified by reference characters 22 and 24.

FIG. 1 shows primarily the polymeric housing 26 of transducer 24. This transducer also includes: (a) an infrared radiation emitter unit 28; (b) a detector unit 30 (shown in FIG. 2); and (c) a detector unit power supply 32.

The illustrated airway adapter 22 is designed for connection between an endotracheal tube inserted in a patient's trachea, and/or some other subject interface appliance, and the plumbing of a mechanical ventilator or other generator of a pressurized flow of breathable gas, and transducer 24 is in this instance employed to measure the expired carbon dioxide level of a medical patient, and/or levels of other gases.

Figure 2:
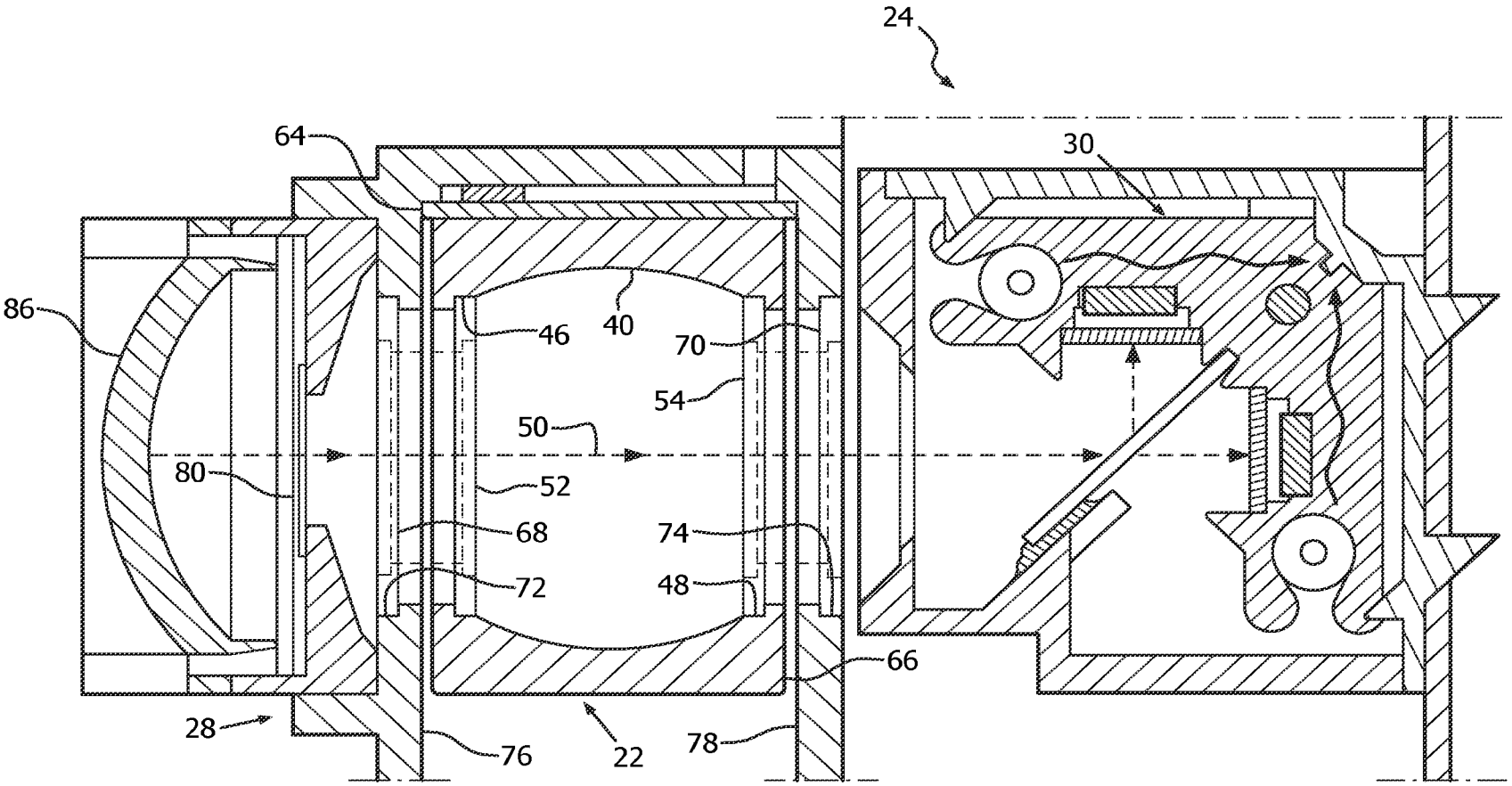
FIG. 2 is a section view of an airway adapter and a transducer.

Referring to FIGS. 1 and 2, airway adapter 22 is a one-piece unit typically molded from Valox polyester and/or other polymers. Airway adapter 22 has a generally parallelepipedal center section 34 and two cylindrical end sections 36 and 38 with a sampling passage 40 extending from end-to-end through the adapter. End sections 36 and 38 are axially aligned with center section 34.

The central section 34 of airway adapter 22 provides a seat for transducer 24. An integral, U-shaped casing element 42 positively locates transducer 24 endwise of the adapter and, also, in that transverse direction indicated by arrow 44 in FIG. 1. Arrow 44 also shows the direction in which airway adapter 22 is displaced to assemble it to transducer 24. Apertures 46 and 48 are formed in the center section 34 of airway adapter 22. With transducer 24 assembled to the airway adapter, these apertures are aligned along an optical path identified by reference character 50 in FIG. 2. That optical path extends from the infrared radiation emitter unit 28 in transducer 24 transversely across airway adapter 22 and the gas(es) flowing therethrough to the infrared radiation detector unit 30 of transducer 24.

To: (a) keep the gases flowing through airway adapter 22 from escaping through apertures 46 and 48 without attenuating the infrared radiation traversing optical path 50, and (b) keep foreign material from the interior of the airway adapter, the apertures are sealed by windows 52 and 54. Windows 52 and 54 may be formed from infrared transmissive materials, such as sapphire or other transmissive materials.

That casing 26 of transducer 24 in which the source unit 28 and detector unit 30 are housed has first and second end sections 58 and 60 with a rectangularly configured gap 62 therebetween. With the transducer assembled to airway adapter 22, the two sections 58 and 60 of transducer casing 26 embrace those two inner side walls 64 and 66 of airway adapter central section 34 in which energy transmitting windows 52 and 54 are installed.

Optically transparent windows 68 and 70 are installed along optical path 50 in apertures 72 and 74 provided in the inner end walls 76 and 78 of transducer housing 26. These windows allow the beam of infrared radiation generated in unit 28 in the left-hand end section 58 of transducer housing 26 to pass airway adapter 22 and from the airway adapter to the detector unit 30 in the right-hand section 60 of the transducer housing. At the same time, windows 68 and 70 keep foreign material from penetrating to the interior of the transducer casing.

Figure 3:
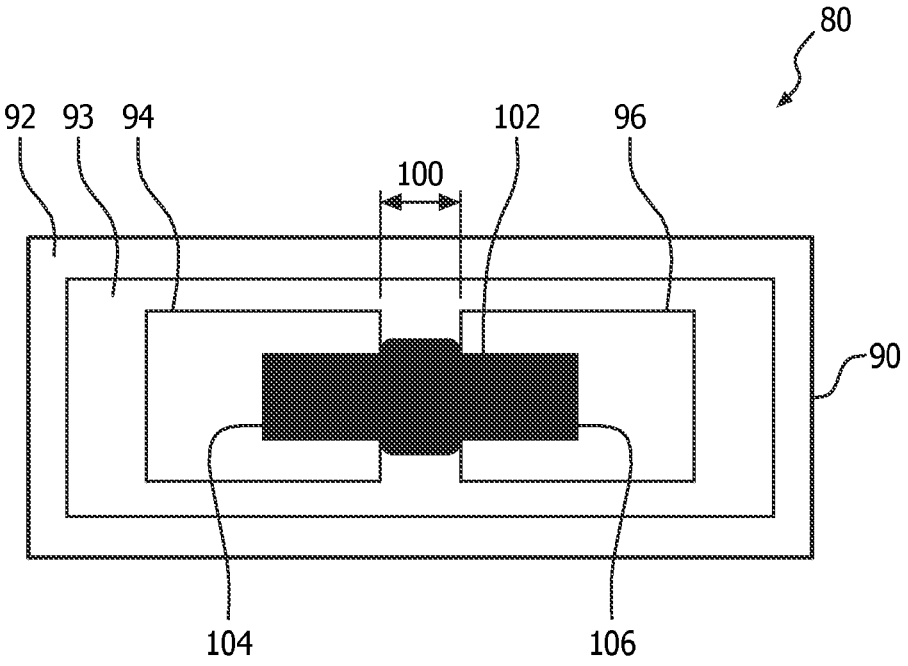
FIG. 3 is an infrared emitter (overview)
Figure 4:
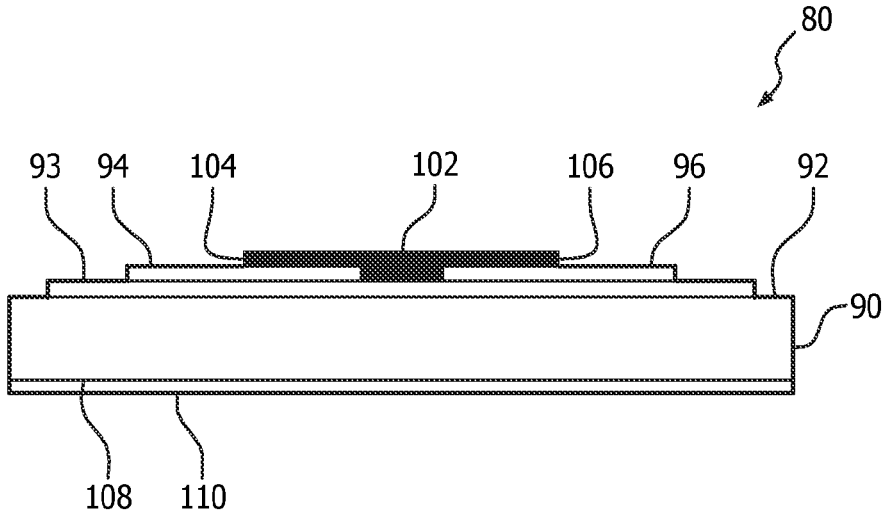
FIG. 4 is an infrared emitter (sideview)

An infrared emitter 80 is held by infrared emitter unit 28, and is configured to emit infrared electromagnetic radiation responsive to an electrical current being applied thereto. FIGS. 3 and 4 illustrate infrared emitter 80 separate and apart from transducer 24. As can be seen in FIGS. 3 and 4, infrared emitter 80 includes a substrate 90 which may be about 0.250 inch long and/or about 0.040 inch wide. In some embodiments, substrate is less than 0.003 inches thick, thereby effectively lowering the overall thermal mass of emitter 80. In some embodiments, substrate is between 0.003 and 0.005 inches thick. Substrate 90 is formed from a material having low thermal conductivity. For example, the thermal conductivity of the material may be less than about 5 W/m ° C., thereby effectively lowering the overall thermal mass of emitter 80. Without limitation, substrate 90 may be formed from one or more of steatite, silica, macor, mica, and/or other materials.

A dispersive layer 93 is disposed on upper surface 92 of substrate 90. Dispersive layer 93 is formed from a material having a high thermal conductivity and low electrical conductivity. Its thermal conductivity is of at least about 100 W/m ° C., of at least about 120 W/m ° C., of at least about 145 W/m ° C., and/or other thermal conductivities. Its electrical conductivity is less than 0.01/Ωm, or less than 0.005/Ωm, and/or other electrical conductivities. Dispersive layer 93 is configured to disperse heat from substrate 90 during use. In some embodiments, dispersive layer 93 covers at least about 70% of upper surface 92, at least about 80% of upper surface 92, at least about 90% of upper surface 92, and/or other proportions of upper surface 92. Dispersive layer 93 can be up to about 50 μm thick, up to about 40 μm thick, up to about 30 μm thick, up to about 20 μm thick, and/or have other thicknesses.

Two electrical leads 94 and 96 are disposed above upper surface 92 of substrate 90. In the exemplary infrared radiation emitter 80 illustrated in FIGS. 4 and 5, and a gap 100 between leads 94 and 96 is about 0.020 inch. In some embodiments, leads 94 and 96 are disposed on dispersive layer 93, with dispersive layer 93 separating leads 94 and 96 from substrate 90.

Leads 94 and 96 are formed from a material having a relatively high electrical conductivity and a relatively high thermal conductivity. For example, leads 94 and 96 may have an electrical conductivity of at least about $4.5\times10^6$/Ωm. Leads 94 and 96 may have a thermal conductivity of at least about 145 W/m ° C. Without limitation, leads 94 and 96 may be formed from one or more of gold, copper, silicon, and/or other materials. Leads 94 and 96 may be bonded to emitter 80. This may be performed through a printing process. The thickness of leads can be up to 20 μm. The thickness can also be controlled to be less than 10 μm and the leads can be spread at least 1 mm from the heating element on the first surface of the substrate to serve as the heat dissipating layer at the same time.

A heating element 102 is superimposed on leads 94 and 96, and is disposed on upper surface 92 of substrate 90. Heating element 102 is a thick film or layer of an emissive, electrically resistive material. By way of non-limiting example, heating element 102 may be formed by firing an ink that includes a large proportion of platinum and has an operating temperature between about 250° C. and about 700° C.

In some embodiments, heating element 102 is about 0.070 inch long. Two ends 104 and 106 of heating element 102 overlap about 0.020 inch onto leads 94 and 96 of emitter 80. Thus, the total overlap may constitute between about 50% and about 60% of the total area of heating element 102.

During operation, leads 94 and 96 connect heating element 102 with a power supply such that a current from the power supply is applied to heating element 102 through leads 94 and 96. Overlaps in the range just described tend to keep the current density at the interfaces between heating element 102 and leads 94 and 96 from becoming too high, which may cause heating element 80 to fail by burnthrough or fatigue cracking of heating element 80.

Figure 5:
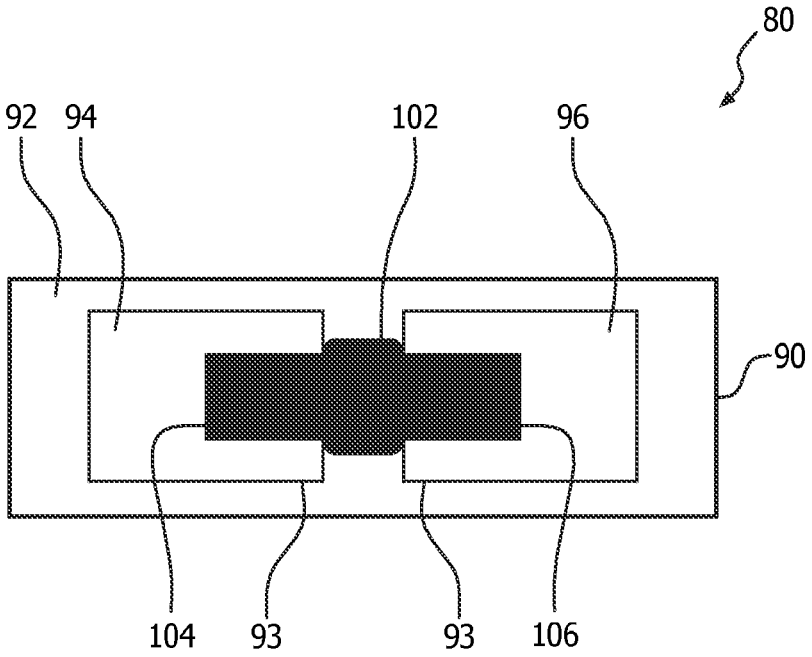
FIG. 5 is an infrared emitter (overview)
Figure 6:
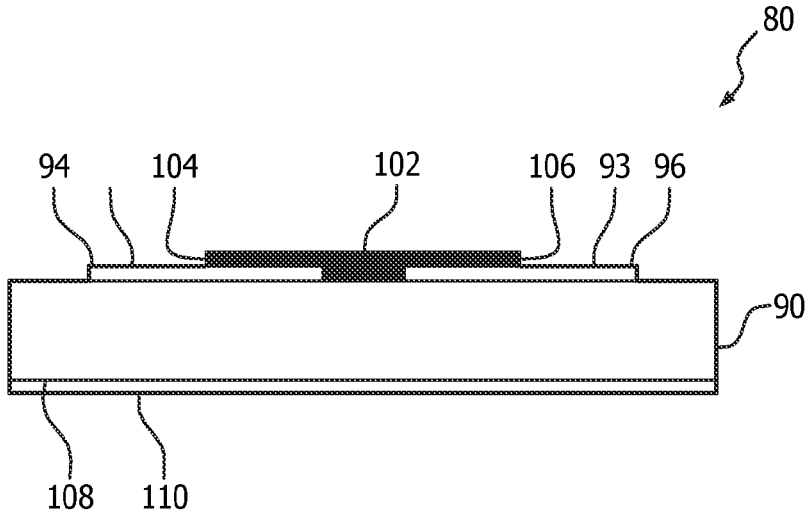
FIG. 6 is an infrared emitter (sideview)

FIGS. 5 and 6 illustrate embodiments of emitter 80 in which dispersive layer 93 is formed by leads 94 and 96 themselves. In such embodiments, dispersive layer 93 is formed as two physically separate sections, one connected to each side of heating element 102. One potential distinction between these embodiments and conventional emitters with printed leads is that in such embodiments, leads 94 and 96 combine to cover the proportions of upper surface 92 set forth above. Without limitation, dispersive layer 93 may be formed from one or more of silicon (e.g., if leads 94 and 96 are formed separately from dispersive layer 93), a metal such as gold or copper (e.g., if leads 94 and 96 form dispersive layer 93), and/or other materials.

On a back surface 108 of substrate 90, a backing layer 110 is disposed. Backing layer 110 covers at least substantially all (e.g., all or substantially all) of back surface 108. Backing layer 110 effectively dissipates heat from substrate 90 during operation. Backing layer 110 may have a thickness less than about 0.00004 inches. Backing layer 110 may have a thermal conductivity of not less than about 145 W/m ° C. Backing layer 110 may be formed from one or more of gold, copper, silicon, and/or other materials.

By virtue of one or more of, among other things, a reduced thermal conductivity of substrate 90, a reduced thickness of substrate 90, increased electrical conductivity of leads 94 and 96, increased thermal conductivity through dispersive layer 93, and/or the addition of backing layer 108, the efficiency of infrared emitter 80 may have a reduced thermal mass and/or may dissipate heat more quickly than conventional emitters. For some conventional heated elements (IR emitters), a certain temperature or temperature modulation needs to be attained for gas detection. This temperature or temperature modulation is the result of dynamic thermal heating and conduction of the IR emitter. With the design and structure of infrared emitter 80, enhanced power efficiency and temperature modulation through the control and balance of pulse energy delivery, thermal mass, thermal insulation and/or heat conduction. The trough temperature during the modulation at a duty cycle may be reduced by the design of infrared emitter 80 up to 60%. The improved power efficiency and delivery may reduce the power consumption, prolong the operation lifetime infrared emitter 80, and/or provide other enhancements such as to afford greater tolerance and optical loss. The improved temperature and temperature modulation may improve the signal to noise ratio, reduce the need of power consumption, and/or provide other enhancements.

Figure 7:
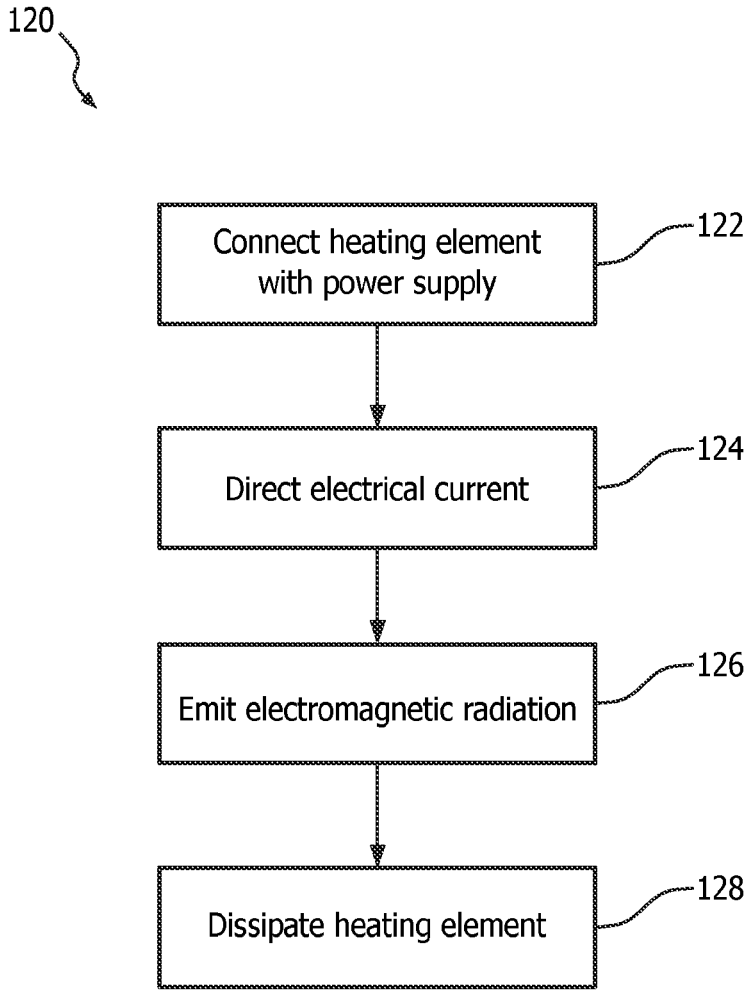
FIG. 7 is method of emitting infrared electromagnetic radiation.

FIG. 7 illustrates a method 120 of emitting infrared electromagnetic radiation. The operations of method 120 presented below are intended to be illustrative. In some embodiments, method 120 may be accomplished with one or more additional operations not described, and/or without one or more of the operations discussed. Additionally, the order in which the operations of method 120 are illustrated in FIG. 7 and described below is not intended to be limiting.

At an operation 122, a heating element is connected with a power supply. In some embodiments, the heating element the same as or similar to heating element 102 (shown in FIGS. 3 and 4 and described herein). In some embodiments, operation 122 is performed by a pair of leads the same as or similar to leads 94 and 96 (shown in FIGS. 3 and 4 and described herein).

At an operation 124, an electrical current is directed through the heating element to induce heating in the heating element. In some embodiments, operation 124 is performed by a pair of leads the same as or similar to leads 94 and 96 (shown in FIGS. 3 and 4 and described herein).

At an operation 126, infrared electromagnetic radiation is emitted responsive to the electrical current. In some embodiments, operation 126 is performed by a heating element the same as or similar to heating element 102 (shown in FIGS. 3 and 4 and described herein).

At an operation 128, heat is dissipated from the heating element. The dissipation of heat from the heating element may increase modulation amplitude, reduce power consumption, enhance longevity, and/or provide other enhancements. In some embodiments, operation 128 is performed by a dispersive layer and/or a backing layer the same as or similar to dispersive layer 93 and/or backing layer 110 (shown in FIGS. 3-6 and described herein).

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the description provided above provides detail for the purpose of illustration based on what is currently considered to be the most practical and preferred embodiments, it is to be understood that such detail is solely for that purpose and that the disclosure is not limited to the expressly disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

What is claimed is:

1. An infrared emitter, the emitter comprising:

a substrate having a first surface and a second surface opposite the first surface, the substrate being substantially planar, the substrate having a thermal conductivity of less than 5 W/m ° C.;

a heating element disposed on a portion of the first surface of the substrate, the heating element being configured to emit infrared electromagnetic radiation in response to an electrical current being introduced thereto;

a heat-dispersive layer disposed on the first surface of the substrate, the heat-dispersive layer of thickness less than 40 covering at least 70% of the first surface, and being formed from a material having a thermal conductivity of at least 110 W/m ° C., the heat-dispersive layer being interposed between at least a portion of the heating element and the first surface of the substrate; and a backing layer disposed on the second surface of the substrate, the backing layer being formed from a material having a thermal conductivity of at least 145 W/m ° C.

2. The emitter of claim 1, wherein:

the substrate is formed from steatite, silica, macor, or mica; and the heat-dispersive layer is formed of silicon or metal.

3. The emitter of claim 1, further comprising a pair of leads carried by the substrate, the pair of leads being configured to connect the heating element to a power supply to facilitate introduction of an electrical current to the heating element, and wherein the pair of leads are disposed on a side of the heat-dispersive layer on an opposite side of the heat-dispersive layer from the first surface of the substrate and wherein the leads have electrical conductivity of at least $4.5\times10^6/\Omega m$.

4. The emitter of claim 1, wherein the heat-dispersive layer is formed as two physically separate sections defining a pair of leads carried by the substrate, the pair of leads being configured to connect the heating element to a power supply to facilitate introduction of an electrical current to the heating element, and wherein the leads have electrical conductivity of at least $4.5\times10^6/\Omega m$.

5. An infrared emitter, comprising:

a substrate that is substantially planar and has a thermal conductivity of less than 5 W/m ° C.;

a heat-dispersive layer disposed on a first surface of the substrate and covering at least 70% of the first surface of the substrate, the heat-dispersive layer having a thermal conductivity of at least 110 W/m ° C.; and a heating element configured to emit infrared electromagnetic radiation responsive to electrical current flow through the heating element, wherein the heating element comprises a layer disposed on the first surface of the substrate with the heat-dispersive layer interposed between at least a portion of the heating element and the first surface of the substrate.

6. The emitter of claim 5, further comprising a backing layer disposed on a second side of the substrate opposite from the first side of the substrate, the backing layer having a thermal conductivity of at least 145 W/m ° C.

7. The emitter of claim 5, further comprising:

leads disposed on the side of the heat-dispersive layer opposite from the substrate and connected to conduct an electrical current through the heating element, wherein the heat-dispersive layer is interposed between the entirety of the heating element and the first surface of the substrate.

8. The emitter of claim 5, wherein the heat-dispersive layer is formed as two physically separate sections defining leads connected to conduct an electrical current through the heating element.

9. An apparatus for supplying air to a patient, the apparatus comprising:

the infrared emitter of claim 1; and an airway adapter configured for connection to an endotracheal tube configured for insertion into a trachea of the patient.

10. An apparatus for supplying air to a patient, the apparatus comprising:

the infrared emitter of claim 5; and an airway adapter configured for connection to an endotracheal tube configured for insertion into a trachea of the patient.

11. The apparatus of claim 9, further comprising, a transducer configured for insertion into a portion of the airway adapter, the transducer being configured to measure an expired carbon dioxide level of the patient;

wherein the emitter is disposed within a housing of the transducer.

12. The apparatus of claim 10, further comprising, a transducer configured for insertion into a portion of the airway adapter, the transducer being configured to measure an expired carbon dioxide level of the patient;

wherein the emitter is disposed within a housing of the transducer.

13. A method of using the infrared emitter of claim 1 to emit infrared electromagnetic radiation, the method comprising:

connecting the heating element with the power supply;

directing the electrical current from the power supply through the heating element via the leads;

emitting infrared electromagnetic radiation from the heating element responsive to the electrical current;

dissipating heat from the substrate through the heat-dispersive layer and dissipating heat from the substrate through the backing layer disposed on the second surface of the substrate.

14. The emitter of claim 5, wherein:

the substrate is formed from steatite, silica, macor, or mica; and the heat-dispersive layer is formed of silicon or metal.

* * * * *